United States Patent [19]

Klokseth

[11] Patent Number: 4,919,231

[45] Date of Patent: Apr. 24, 1990

[54] DEVICE WITH A LIFELINE

[76] Inventor: Per Klokseth, 6375 Hovdenakken, Norway

[21] Appl. No.: 243,973

[22] Filed: Sep. 13, 1988

[51] Int. Cl.[5] ..... A62B 35/00

[52] U.S. Cl. ..... 182/5; 188/65.1

[58] Field of Search ..... 182/5, 6, 7, 70; 188/65.1, 65.2

[56] References Cited

U.S. PATENT DOCUMENTS

| | | | |
|---|---|---|---|
| 200,387 | 2/1878 | Garoutte | 182/5 |
| 481,923 | 9/1892 | Badger | 182/6 |
| 848,235 | 3/1907 | Garland et al. | 182/7 |
| 4,079,811 | 3/1978 | Driskell | 182/70 |
| 4,372,422 | 2/1983 | Sharp | 182/5 |

*Primary Examiner*—Reinaldo P. Machado
*Attorney, Agent, or Firm*—James E. Pittenger

[57] ABSTRACT

The invention refers to a lifeline device which is designed to lower persons from a burning building, after evacuation through a window, distinguished by the lifeline (A) having a length which corresponds to the mounting height of the equipment above the ground over a friction pulley (B) having a circumferential groove (C), which will cause braking said lifeline is threaded to occur under the weight of the person being lowered. The friction pulley of the pulley and lifeline (B) has a centered over-dimensioned axle hub (D) and runs between two bolts (E,E') attached to the sideplates (F) forming a pulley housing, which is fastened with a bracket (G) to a window sill or other structure. Under loading, the line (A) locks the friction pulley (B) against the bolts (E,E') so that the line is pulled through the friction pulley's groove (C) and the line passes between two bolts (H) placed in the lower end of the housing (F) to hold the line within the groove (C). With the lifeline coiled up, a safety harness (I) made of a suitable soft material is fastened to the short end of the like before use. The lifeline (A) is stored in a cassette (J) fitted with a sliding lid (K) with line release (L). By pressing the lid the line is released and the cassette can be thrown out of the window. The lifeline (A) which runs across the friction pulley (B) can easily be returned to the original position when the unloaded friction pulley is freed to rotate in the reverse direction.

7 Claims, 2 Drawing Sheets

DEVICE WITH A LIFELINE

BACKGROUND OF THE INVENTION

The following invention is intended to provide a lifeline which can quickly lower persons from a burning house or building through a window. Considering the major fires which have occurred in recent years, it is incomprehensible that no acceptable solution has been reached earlier regarding how a person in danger should be able to escape through the window of a burning building. A recent example is the last major hotel fire where several people could have been saved if they had been able to lower themselves by means of such a lifeline which could be thrown out of the window.

There are already recognized appliances with lifelines which are installed in a casing with a pulley and line, where the line is coiled around the line pulley. The line pulley is equipped with spring-loaded centrifugal weights with rotation dependent on the rotation speed, which are thrown out and directly or indirectly activate a braking appliance for the pulley line.

Such previously recognized appliances with lifelines have a complicated construction and are therefore expensive to manufacture. Thus they are less suitable—also for economic reasons—for installation in large quantities as escape equipment in buildings where a fire will probably never occur. Such appliances with lifelines are further designed to be installed so that they will always function in the same place for several decades. Particularly in built-up areas, and in areas with salt-laden sea air, corrosion can occur so that the spring-loaded centrifugal weights can rust solid. Such corrosion damage can prevent the centrifugal weights being thrown out or they may be thrown out at too fast a speed. The fall speed is then too high and such a lifeline can then be positively dangerous to use.

There is also a simple appliance comprising a pulley line and a lifeline which has a length of at least double the required height. The descent is controlled by the person using the line or by a helper, by pulling on the other end or portion of the line. Such a lifeline cannot, however, be used by injured or physically weak people without help, and it is therefore not a fully viable means of escape in the event of fire.

Taking into account the disadvantages of the earlier known safety appliances, the aim of the following invention is to produce a device with a lifeline which is cheap and thus can be installed in large numbers, can be used by one person even if that person is injured or physically weak, has a safe mechanism whose efficiency cannot be reduced by storage damage and which has a simple construction with few moving parts.

SUMMARY OF THE INVENTION

The new and characteristic aspects of the invention are that the lifeline has a length which corresponds to the specified mounting height and that the line runs over the groove in a friction pulley which causes braking under the load of the person being lowered. Further the pulley itself has a centered over-dimensioned axle wheel and runs between two bolts which are fixed rigidly to two side plates, which form a housing, which is fastened by means of a bracket to the windowsill. The line pulley is locked by friction with bolts when the line is loaded, so that the line slides in the pulley's groove and so that the line also passes between two pins placed in the lower end of the two sideplates to hold the line in the keyway and thus increase the effective angle of the installation. A safety harness—made of a suitable soft material—is fastened to the shortest end of the line when the safety line is coiled up. Further, the lifeline is stored in a cassette equipped with a sliding lid with a line release. By pressing the sliding lid down the cassette and the longest end of the line is freed, which can then be thrown out through a window. Furthermore, the line, which runs around the friction pulley, can easily be hauled up to the exit position when the unloaded pulley runs freely back.

As is shown above, the friction pulley is locked fast, and does not rotate, when the lifeline is used to lower a person. It therefore makes no difference if the line pulley should eventually rust solid since it is not intended to rotate during the lowering process. On the other hand, it may be difficult to draw the line up again to lower down other persons.

BRIEF DESCRIPTION OF THE DRAWINGS

The invention shall be defined more exactly in the following with reference to the attached drawings. The drawings show.

DETAILED DESCRIPTION OF THE INVENTION

When an emergency situation arises and the line safety cassette is to be used, one presses the sliding lid down (about 10 cm) with the help of the line release. The cassette is now freed from the friction pulley device and the safety harness can also be freed. The lifeline is then thrown out of the window. The safety harness, which is fastened to the shortest line end, is now pulled over the head and under the arms and the person takes hold of the longer line end (that which is thrown out) and lowers himself or herself down to the ground or other safe level. Braking is now very simple since the line goes through the frction pulley and the person can now regulate the lowering process by holding the longer line end.

As is shown above the line pulley device can be freed very quickly and the line is ready for use. This is an important advantage of the invention, since it is very important in an emergency situation that the lifeline can be quickly prepared.

The figures show a lifeline A, which runs over a friction pulley B having a groove-shaped track C for the line. The pulley has a central over-dimensioned axle aperture or hub D. The pulley runs between two bolts E and E′ which are securely fastened in the two side plates F, which create a housing. The distance between the bolts E and E′ is a little greater than the difference between the pulley B's outer radius and the axle hub D's radius. The housing which is formed by the side plates F has a fastening bracket G for permanent mounting of the escape device to a window sill or other structure. Two pins H are placed at the lower end of the sideplates F. The two ends of the two lifeline are threaded between the pins H which determine the line's feed and the contact angle with the friction pulley B. The lifeline's loaded downward end M is found on the right side of the pulley and is therefore furthest from the bolt E, while the unloaded return end N is routed upward past bolt E′. By pulling on the lines downward end M, the longer movement arm between the right side of the pulley B and bolt E causes the pulley B to tilt or roll slightly downward causing the left side of the pulley to move upward and outward to contact the bolt E′ causing contact friction between the pulley and the bolts E and E′ to lock the pulley and prevent its rotation while the line is pulled against and through the groove C.

Figure 4:
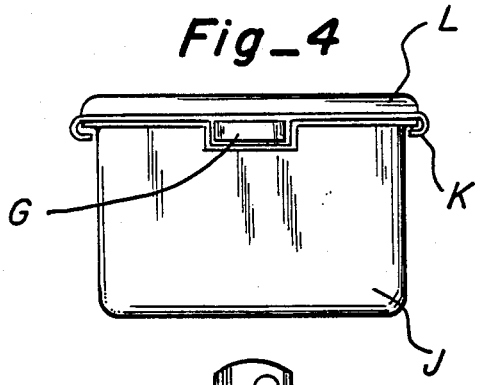
FIG. 4 is an top plan view of the cassette lid with line release showing the mounting bracket.
Figure 3:
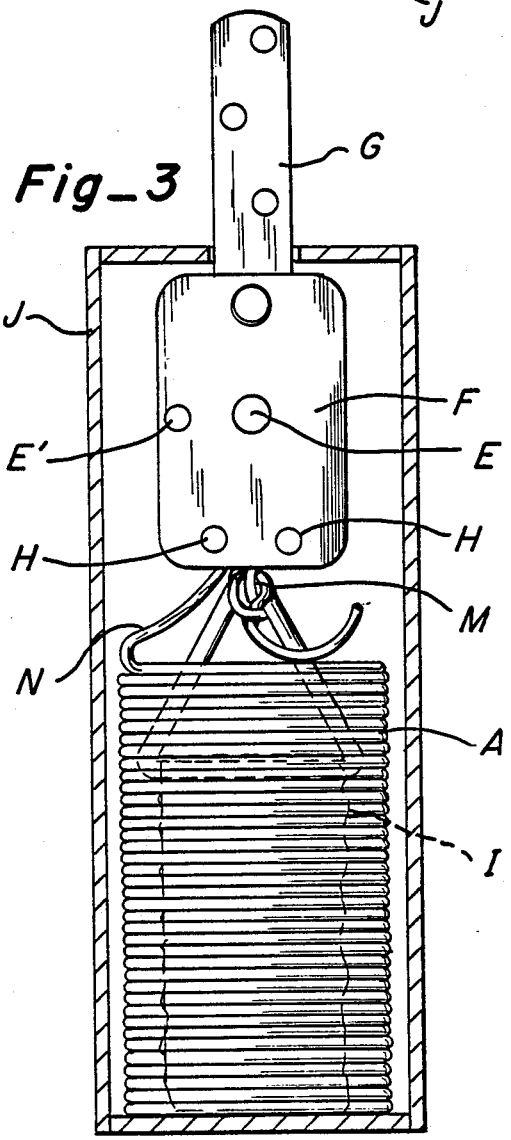
FIG. 3 is a detail view of a safety cassette with sliding lid removed and also shows a coiled-up lifeline according to the invention.

FIG. 3 shows a device, according to the invention, packed in a cassette J in readiness for immediate use. The line part M which is designed for loading and lowering is attached to a safety harness I. The non-loaded line end N is coiled within the cassette and is fastened at its free end to the cassette (not shown). When the cassette is in the mounted position it encapsulates the line pulley B with its sideplates F together with an outlet for the passage of the fastening bracket G. The cassette has a sliding lid K with a line release L which is shown in FIG. 4.

Figure 5:
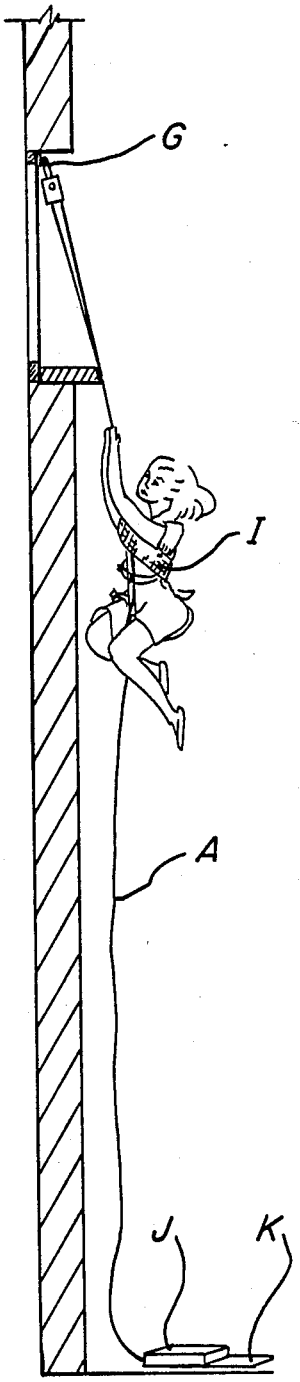
FIG. 5 is a side elevation view which illustrates how a person lowers himself after escape through a window and also shows the cassette itself with the longest line end thrown on the ground.

In using the escape device, the sliding lid K is pulled out slightly with the line release so that the line pulley and its housing are freed from the cassette J. Thereafter the cassette is thrown from the window, and the unloaded line N is drawn out of the cassette as shown in FIG. 5. Thereafter the person to be rescued pulls the safety harness I over the head and under the arms. By holding on to the unloaded line N the friction pulley B is brought into the braking position, which will be explained in more detail below, and a gradual descent can occur. During the first stage of the descent the descent speed can be controlled by pulling on the unloaded line N. As mentioned above, the complete length of the line corresponds to the mounting height. The final phase of the descent therefore occurs hanging freely from only the loaded line part M. The friction resistance to the line's movement in the groove C then limits the speed of descent. The cassette J can now act as a counterweight which guarantees safe positioning of the line A in the keyway track C.

Figure 1:
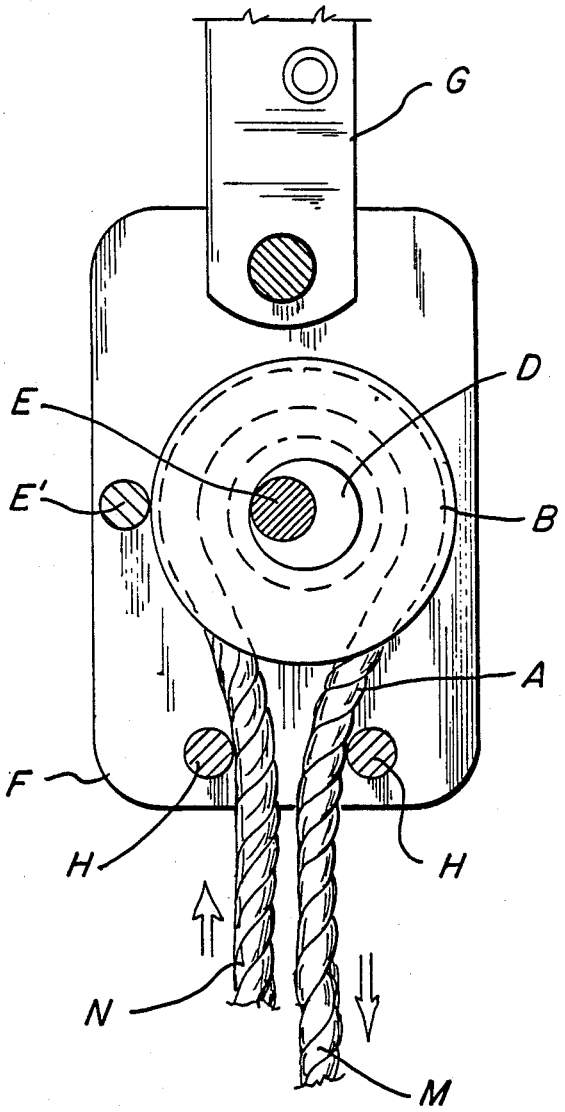
FIG. 1 is a side elevation view of a device in accordance with the invention, with the front side plate taken away thus showing a lifeline which runs around a friction pulley guided by an inner and an outer bolt.
Figure 2:
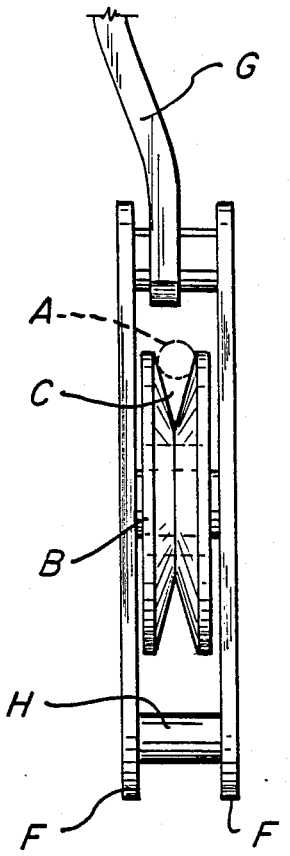
FIG. 2 is a side elevation view of the device in FIG. 1 showing the line pulley with a groove positioned between two sideplates and mounted on a bracket.

The principles for the function of the invention are explained below. The friction resistance for a line which is moved over a non-rotating line pulley depends partially on the friction coefficient, and partly on the device's surface contact angle. The greater the contact angle the greater the friction resistance and the slower the line's movement around the line pulley. As is shown in FIG. 1, the contact angle of the line is determined by the pins H. Depending on the friction coefficient of the line material chosen in relation to the friction pulley the positioning of the pins H can be chosen, so that a suitable contact angle and the desired frictional resistance can be achieved. The position of the pins is chosen so that the contact angle is greater than 180° but less than 360°. A value of 210°–330° can be chosen, but a value of 240°–300° is desirable. With loading of the line the line portion M has a greater moment arm than the line portion N. The loading of line portion M will cause the line pulley to rotate against bolt E and thus the outside edge of the pulley will come into contact against bolt E′. Thus the line pulley is locked and secured from rotating. By pulling the opposite side of the line the moment arm is shorter and the angle relation changed so that the pulley lock will be released, and the line can easily be pulled back with the rotating pulley.

I claim:

1. A lifeline device for lowering persons from a burning building, the device comprising a housing with a line pulley means mounted therein and a lifeline, characterized by the line pulley means being made up of a freely rotatable friction-pulley having a grooved-shaped track, the lifeline having a first lowering end and a total length corresponding to the mounting height of the device from the ground, said lifeline being designed to slide through the friction pulley groove when locked, and the friction-pulley includes means which will cause the pulley to lock to prevent rotation when the weight of a person being lowered is applied to the lifeline.

2. A device in accordance with claim 1, characterized by the friction pulley having a centered over-dimensioned axle hub, the housing having a pair of adjacent bolts mounted near one edge, and the lifeline is threaded between the bolts which are fastened between a pair of side plates forming the housing means, said housing means including a bracket which can be attached to a windowsill or other secure structure.

3. A device in accordance with claim 2 characterized by the lifeline's lowering end, which is the shortest end when the line is coiled, is attached to a safety harness made of a suitable soft material.

4. A device in accordance with claim 2 characterized by the lifeline being positioned in a cassette, said cassette being equipped with a sliding lid with a line release means whereby by pulling the lid down the line will be released, and the cassette is freed to be thrown out window so as to extend the lifeline.

5. A device in accordance with claim 1 wherein the friction pulley includes means whereby the lifeline can be drawn backward across the friction pulley to release the pulley so that it can freely rotate backward to retrieve said lifeline.

6. A device with a lifeline, the device comprising a box-shaped cover with an open longitudinal side covered with a slidable lid on the open side, the lid being detachable prior to the use of the lifeline so that the lifeline can be released from the cover.

7. A device in accordance with claim 1 which includes a cassette cover means containing said line pulley means and lifeline, said cover means having an open longitudinal side, said open side being covered with a slidable lid means to retain the lifeline therein, said slidable lid means being detachable whereby the lifeline can be released from the cassette cover means prior to the device being used.

* * * * *